United States Patent [19]

Cash

[11] 4,216,688

[45] Aug. 12, 1980

[54] PANEL CUTTING MACHINE AND METHOD

[75] Inventor: David R. Cash, Louisville, Ky.

[73] Assignee: James Cash Machine Co., Louisville, Ky.

[21] Appl. No.: 909,799

[22] Filed: May 26, 1978

[51] Int. Cl.[2] ..... B26D 5/40; B26D 7/28

[52] U.S. Cl. ..... 83/42; 83/56; 83/208; 83/365; 83/209; 83/369; 83/250

[58] Field of Search ..... 83/208, 209, 365, 367, 83/369, 42, 56, 250

[56] References Cited

U.S. PATENT DOCUMENTS

| | | | |
|---|---|---|---|
| 3,611,856 | 10/1971 | Adair | 83/363 |
| 3,986,419 | 10/1976 | Cleghorn | 83/208 X |
| 4,084,467 | 4/1978 | Schwarz | 83/208 |

*Primary Examiner*—Donald R. Schran

*Attorney, Agent, or Firm*—Maurice L. Miller, Jr.

[57] ABSTRACT

A panel cutting machine having a table with an endless belt conveyor and a pair of rollers mounted thereon for advancing a fabric to be cut to a desired length across and beyond a line of cut of a cross-cutter and along the table toward a sensor located a preselected distance from the line of cut. The sensor, which may be the usual microswitch or a photo-electric sensor switch, responds to the arrival of the leading edge of the fabric to activate a roller revolution counter to count a predetermined number of further revolutions and fractions thereof of one of the rollers, corresponding to a further distance of advance of the leading edge of the fabric beyond the sensor. Upon completion of the count, the counter activates a control circuit to stop the rollers and conveyor and start a cross-cutter to cut the fabric along the cutting line to form a panel of the desired length.

7 Claims, 3 Drawing Figures

ROLLER REVOLUTION COUNTER
PHOTO ELECTRIC SCANNER
240 V. 3φ
120 V.
240 V.
1
2
3
18
22
24
26
28
30
32
40
42
50
52
54
56
58
60
62
64
64a
64b
66
68
70
74
76

PANEL CUTTING MACHINE AND METHOD

BACKGROUND OF THE INVENTION

This invention relates generally to improvements in cutting machines for forming cloth panels of desired length for use with mattresses and other articles.

Generally speaking, panel cutting machines have long been known and used in the prior art. Typically, such machines feature a pair of rollers, through which is fed a cloth fabric to be cut to the desired length. The rollers feed the fabric across the line of cut of a motor driven cross-cutter blade and onto a table containing a multi-belted conveyor, whereupon the conveyor carries a free end portion of the fabric away from the cutting line. While the rollers and conveyor are carrying the fabric along the table, a roller revolution counter associated with the driven roller counts the revolutions and fractions thereof, indicative of the distance that the leading edge of the fabric has moved beyond the cutting line. Upon the occurrence of a preselected accumulated angular displacement of the driven roller, the counter activates a control circuit to shut down the roller and conveyor drive motor and simultaneously activate the cross-cutter motor to propel the cross-cutter blade transversely across the table to cut the fabric and form a panel of the desired length. Upon completion of the cut, the assembly upon which the blade is mounted engages one of a pair of limit switches located on opposite sides of the table to de-energize the cross-cutter motor and restart the conveyor and roller drive motor in preparation for the next panel cutting cycle. In the meantime, the roller revolution counter has automatically reset and indexed itself in preparation for a new counting operation commencing when the roller and conveyor drive motor restarts at the beginning of the next panel cutting sequence.

One difficulty that has been encountered using such prior art panel cutters is inaccuracy in the length measurement of the fabric by the roller revolution counter. Such inaccuracy results from slippage of the fabric within the rollers. Also, when such machines are used with fabrics of varying texture and thickness, the degree of mashing or flattening of the material passing through the rollers varies. Accordingly, variations in length measurement may occur when cutting different fabrics to the same length on the same machine.

By means of my invention, these and other difficulties encountered in the use of prior art panel cutting machines are substantially lessened and overcome.

SUMMARY OF THE INVENTION

It is an object of my invention to provide a panel cutting machine having improved accuracy in cutting cloth fabric to the desired length.

It is a further object of my invention to provide a panel cutting machine which produces similar sized panels which have improved uniformity of length.

Briefly, in accordance with my invention, there is provided an improved panel cutting machine of the type which includes a table, roller and conveyor means for advancing a fabric onto and along the table, and a cross-cutting means disposed on the table for cutting the fabric to the desired length to form a panel. The improved features of the machine include means attached to the table for sensing when a leading edge of the fabric has advanced to a preselected position beyond the cross-cutting means. Also included is a roller revolution counting means responsively connected to the roller and sensing means for de-activating the roller and conveying means and for activating the cross-cutting means when the leading edge has advanced a preselected distance beyond the preselected position, whereby the fabric is cut to a desired length to form a panel.

These and other objects of my invention will become apparent to those skilled in the art from the following detailed description and attached drawings upon which, by way of example, only the preferred embodiment of my invention is illustrated.

DESCRIPTION OF THE PREFERRED EMBODIMENT

Figure 1:
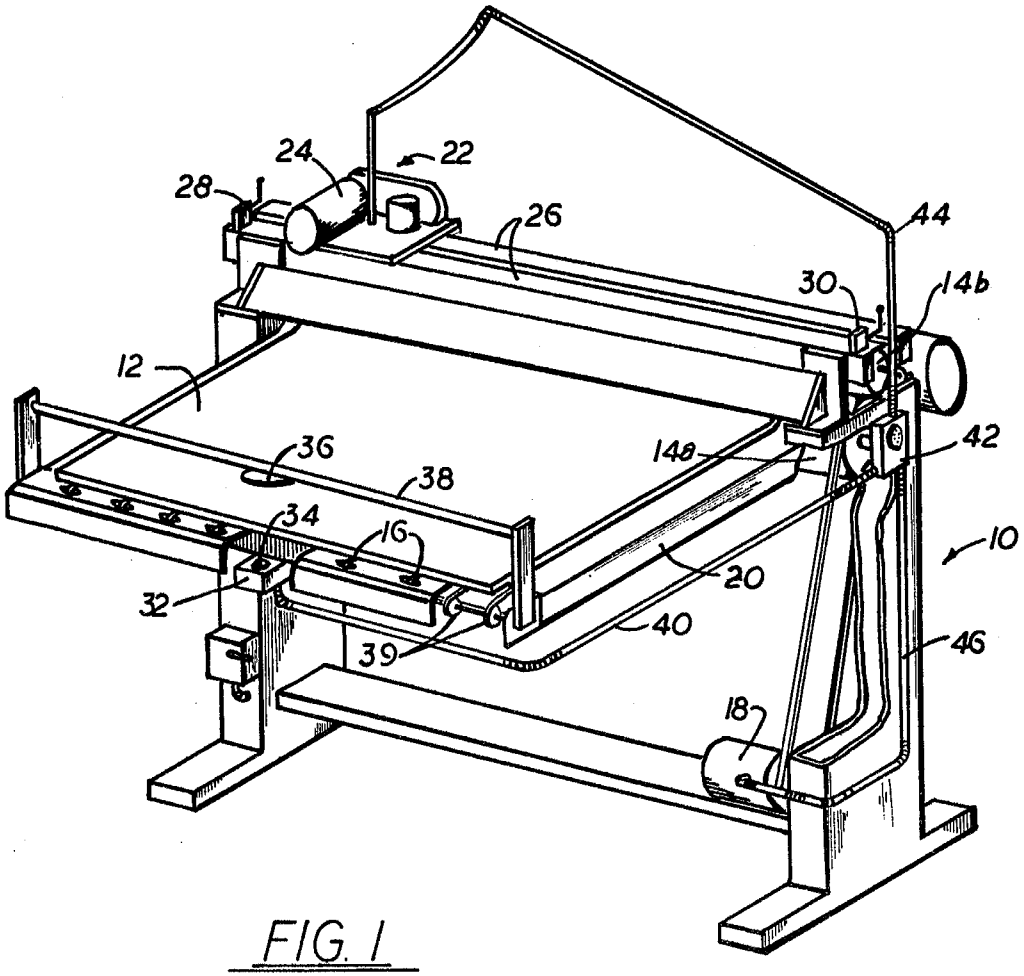
FIG. 1 shows an oblique projection of a panel cutting machine, thus illustrating one preferred embodiment of my invention.

Referring now to FIG. 1, there is shown a panel cutting machine 10 for cutting a mattress fabric 12 or other material to length. The machine 10 includes such prior art structure as a pair of elongated rollers 14*a, b* through which the fabric 12 to be cut is fed onto a multi-belted conveyor 16. A 240 volt, 3 phase motor 18 drives one of the rollers 14*a* and the series of endless belts of the conveyor 16 to carry the fabric 12 along a table 20 in a conventional manner. A suitable cross-cutter assembly 22 is provided consisting of the usual cutter blade, not shown, and a 240 volt, 3 phase drive motor 24. The motor 24 powers the cutter blade and propels the assembly 22 across the table 20 along a track 26 upon command to effect cutting of the fabric 12 to the desired length, all in the usual, well known manner. A pair of limit switches 28, 30 disposed on opposite end portions of the track 26 are engaged by the assembly 22 as it completes a traverse of the table 20 to actuate de-energizing means for the motor 24 and braking means for the assembly 22. An example of a prior art panel cutting machine having the foregoing well known features is the K-10 panel cutter as manufactured and sold by James Cash Machine Co., Inc., 625 West Hill Street, Louisville, Ky. 40208.

Now, in accordance with the principles of my invention, a sensing means for sensing the arrival of the leading edge of the fabric 12 at a preselected position located a known distance from the line of cut of the cutter blade is provided. Such means may include the usual microswitch or other alternative form of switch well known in the art, or as is preferred and shown in the present example, a suitable photo-electric scanner 32. The scanner 32 is preferably mounted in the free end of the table 20 such that its photo-electric eye 34 is aligned to project a light beam vertically upward into a reflector 36 attached above the free end of the table 20 to a suitable frame 38. The scanner 32 should be located between adjacent sprockets 39 of the conveyor 16 below the level of the fabric carrying portions of the belted conveyor 16 so as not to interfere with the passage of the fabric 12 thereover. It is not essential that the eye 34 be positioned at the mid-point in the width of the table 20. Neither is it essential that the eye 34, or alternative switching means employed, be located at a precise selected distance from the line of cut of the cutter blade on the assembly 22. Once the scanner 32 is set in place in the table 20, the precise distance from the eye 34 to the cutter blade can then be determined. The frame 38 should be elevated above the free end of the table 20 a distance sufficient to permit passage of the fabric 12 thereunder, and to permit handling of the fabric 12 at the end of the table 20 as necessary.

The scanner 32 is operatively connected by means of an electrical control line 40 to a roller revolution counter 42 which is, in turn, mechanically and responsively linked to the driven roller 14*a* in a suitable and well known manner. The counter 42 may be of conventional type such as, for example a Microflex Revolution Counter as manufactured and sold by Eagle Signal Division of Gulf and Western Industries, Inc., 736 Federal Street, Davenport, Iowa. The counter 42 is adapted to precisely monitor a selected number of revolutions of the roller 14*a*, including fractions thereof, as manually set on an adjustable vernier dial, and to close a relay upon reaching the selected number of revolutions. The counter 42 is operatively connected through electrical lines 44 and 46 to the cross-cutter motor 24 and conveyor and roller drive motor 18, respectively, to start the cutter operation and simultaneously stop the roller and conveyor feed operation when the selected number of roller revolutions has occurred.

Figure 2:
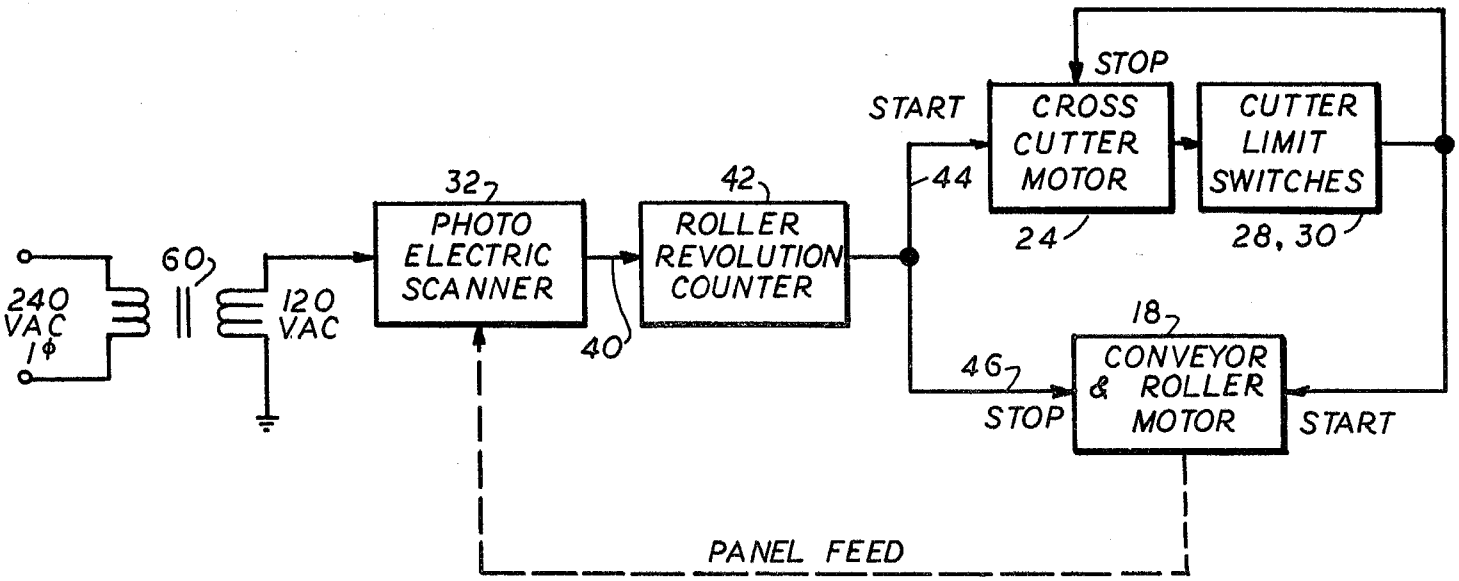
FIG. 2 shows a block or flow diagram of the operation of the machine of FIG. 1.

Referring now to FIGS. 1 and 2, the sequence of operation of the machine 10 will now be explained. Assume that the fabric 12 has been fed by the rollers 14*a, b* and conveyor 16 to the point at which the leading edge of the fabric 12 interrupts the light beam emitted by the eye 34. At this instant, a precisely known length of the fabric 12 lies between the eye 34 and the line of cut of the cutter blade depending from the assembly 22. The photo-electric scanner 32 thereupon triggers the roller revolution counter 42 to commence counting further revolutions of the roller 14*a*. Since the diameter of the roller 14*a* can be precisely measured, the count of the counter 42 corresponds to the distance of advance of the leading edge of the fabric 12 beyond the eye 34. When the desired full count is reached, the counter 42 shuts down the conveyor and roller drive motor 18 and, simultaneously, energizes the cross-cutter motor 24 to cut the fabric 12 to the desired length. Inaccuracies in the roller revolution counter 42 due to slippage of the fabric 12 in the rollers 14*a, b* is minimized because the counter 42 is only used to measure a portion of the length of the fabric 12 to be cut into a panel, for example, approximately one-half of the the length. Initial length measurement of the fabric 12 is accomplished by simply conveying the leading edge thereof a known distance between the cutter and the eye 34. After the cutting operation is completed, the portion of the fabric 12 which has advanced over the free end of the table 20 can be collected by any suitable means to remove the cut panel from the table 20, whereupon the machine 10 is ready for the next cutting operation. The cut panel may simply be permitted to fall from the end of the table 20 to be manually stacked with previously cut panels or, in the alternative, a conventional stacking machine may be employed. After the counter 42 has reached the selected full count and initiated the cutting operation, it automatically resets and indexes itself in a well known manner in preparation for a subsequent panel length measurement and cutting operation.

Figure 3:
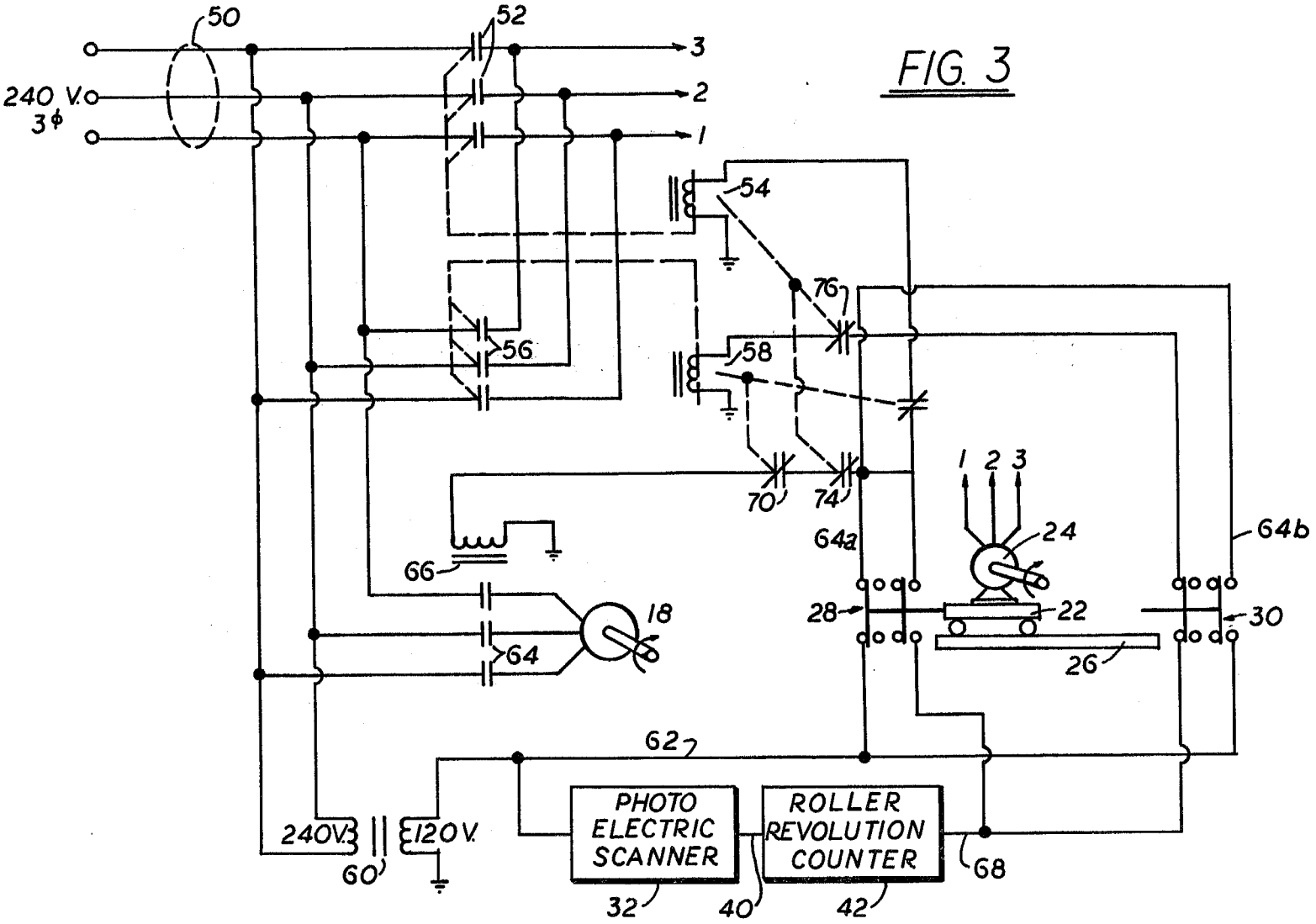
FIG. 3 shows a schematic diagram of an electrical control circuit for the machine of FIG. 1 operable in accordance with the flow diagram of FIG. 2.

Referring now particularly to FIG. 3, an electrical control circuit for the machine 10 of FIG. 1 will now be explained. Driving power for operation of the motors 18 and 24 is supplied from a 240 volt, three phase source through lines 50. A reversing circuit is provided wherein three normally open switches 52, closable by energizing a relay coil 54, apply driving power to drive the cutter motor 24 and assembly 22 in one direction across the table 20. Similarly, three normally open switches 56, closable by energizing a relay coil 58, apply driving power to drive the cutting motor 24 and assembly 22 in the opposite direction across the table 20. Reversing of the direction of travel of the assembly 22 is accomplished by the switches 52, 56 simply by reversing two of the three phases of the line 50 being applied through them to the motor 24.

A two-to-one step-down transformer 60, having a 240 volt primary winding connected across any two phases of the main power line 50, supplies 120 volt, single phase power on a line 62 to control the operation of the conveyor and roller drive motor 18. The conveyor and roller drive motor 18 is energized by normally open relay contacts 64 closed by energizing a relay coil 66 connected to the line 62 through either the switch 28 or 30, depending upon which of these switches happens to be undepressed by the assembly 22. When the cross-cutter motor 24 is in motion between the switches 28, 30, the latter switches open the lines 64*a* and *b* connected between the line 62 and the relay coil 66 so that the contacts 64 are open and the motor 18 is de-energized. Accordingly, the conveyor and roller drive motor 18 is operative only when one or the other of the switches 28, 30 are depressed and when the cutter motor 24 is inoperative.

Now when the scanner 32 is activated by the leading edge of the fabric 12, the scanner switch closes to connect the line 62 to the line 40 to start the counter 42. When the counter 42 completes the desired count, the line 40 is connected to a line 68 which, in turn, energizes either the relay coil 54 or the relay coil 58 depending upon whether the switch 28 or 30 is then depressed by the assembly 22. Accordingly, where the switch 28 is depressed by the assembly 22, the switch 30 connects the line 68 to the coil 58 to close the contacts 56 and drive the assembly 22 in one direction across the table 20. At the same time, the now energized coil 58 opens a pair of normally closed contacts 70 and 72 to de-energize the coil 66 and motor 18 and to maintain the coil 54 in a de-energized state.

Conversely, where the switch 30 is depressed by the assembly 22, the switch 28 connects the line 68 to the coil 54 to close the contacts 52 and drive the assembly 22 in the opposite direction across the table 20. At the same time, the now energized coil 54 opens a pair of normally closed contacts 74 and 76 to de-energize the relay coil 66 and the motor 18 and to maintain the coil 58 in a de-energized state. Thus, only one of the coils 54, 58 can be energized at a given time to drive the cutter motor 24 across the table 20 in one direction. During operation of the cutter motor 24 in either direction, the motor 18 is maintained in an inoperative state.

I have found it preferable to place the scanner eye 34, or alternative switch sensing means employed, at a distance from the line of cut of the cutter blade which is approximately one-half of the length of the panel to be cut. The counter 42 is then adjusted to measure revolutions of the roller 14*a* equivalent to the remaining one-half of the panel length to be cut. In this manner, I have found that the accuracy and uniformity of panel length obtained is increased and the variation in actual panel lengths from the desired length is reduced by approximately one-half as compared with panels cut on machines which use a counter to measure the entire panel length. Moreover, by using both a table length measurement and roller counter measurement in combination in order to obtain the desired panel length, the table length can be reduced by as much as one-half as compared with prior art tables which use the table length to make the entire panel length measurement without substantial sacrifice in accuracy. In some cases, it will be possible to obtain substantially the same accuracy of panel length with my machine as is possible using machines whose conveyor tables are as much as twice as long, thus resulting in a substantial savings in factory floor space.

Although the subject invention has been described with respect to specific details of a certain preferred embodiment thereof, it is not intended that such details limit the scope of the invention, otherwise than as set forth in the following claims.

I claim:

1. In an improved panel cutting machine of the type comprising a table, roller and conveying means for advancing a fabric onto and along said table, and cross-cutting means disposed on said table for cutting said fabric, so advanced, to a desired length to form a panel, the improvement of which comprises means attached to said table for sensing when a leading edge of said fabric has advanced to a preselected position beyond said cross-cutting means, and roller revolution counting means responsively connected to said roller and sensing means for de-activating said roller and conveying means and for activating said cross-cutter means when said leading edge has advanced a preselected distance beyond said position, whereby said fabric is cut to a desired length to form a panel.

2. The machine of claim 1 further comprising limiting means for de-activating said cross-cutting means and for activating said roller and conveying means when said panel is formed.

3. The machine of claim 1 wherein said sensing means comprises a photo-electric scanner adapted to generate a beam of light, and a reflector disposed in spaced relation to said scanner in line with said beam for interruption of said beam by said fabric when said leading edge has advanced to said position.

4. The machine of claim 2 wherein said limiting means comprises a pair of limit switches disposed in responsively engaging relation with said cross-cutting means at opposite ends of a line of travel of said cross-cutter means.

5. A process for controlling the cutting of a fabric to a desired length to form a panel, the steps of which comprise moving a fabric across and beyond a cutting line and along a table with a pair of rollers and a conveyor such that a leading edge of said fabric arrives at a position a peselected distance beyond said cutting line, counting a preselected number of revolutions of one of said rollers commencing with the arrival of said leading edge at said position, stopping said rollers and conveyor upon completion of the step of counting to stop the further movement of said fabric along said table, and cutting said fabric along said cutting line commencing with the stopping of said rollers and conveyor to thereby form said panel.

6. The process of claim 5 further comprising the step of starting said rollers and conveyor upon completion of the step of cutting.

7. The process of claim 5 further comprising the step of photo-electrically sensing the arrival of a leading edge of said fabric at said position.

* * * * *